United States Patent [19]

Gunewardena et al.

[11] 4,064,472

[45] Dec. 20, 1977

[54] COMPACT INDUCTOR

[75] Inventors: Shelly J. Gunewardena, Lynwood; Leslie P. Glick, N. Hollywood; Yoshinobu F. Sakihara, Los Angeles, all of Calif.

[73] Assignee: Vanguard Electronics Company, Inc., Inglewood, Calif.

[21] Appl. No.: 674,758

[22] Filed: Apr. 8, 1976

[51] Int. Cl.[2] ..... H01F 15/10; H01F 27/30

[52] U.S. Cl. ..... 336/65; 174/52 PE; 264/274; 336/96; 336/192; 338/269; 338/322

[58] Field of Search ..... 336/192, 65, 96, 92; 338/269, 275, 322; 174/52 PE; 264/274

[56] References Cited

U.S. PATENT DOCUMENTS

| | | | |
|---|---|---|---|
| 2,127,043 | 8/1938 | Most | 264/274 |
| 2,393,751 | 1/1946 | Chott | 264/274 X |
| 2,791,116 | 5/1957 | Heuer et al. | 264/274 X |
| 3,321,168 | 5/1967 | D'Entremont | 336/65 |
| 3,332,048 | 7/1967 | Renskers | 336/192 X |
| 3,466,381 | 9/1969 | Boehmke | 336/192 X |
| 3,491,441 | 1/1970 | Belsaas | 264/274 X |
| 3,534,309 | 10/1970 | Renskers et al. | 336/192 X |
| 3,824,518 | 7/1974 | Slenker | 336/192 X |

*Primary Examiner*—Thomas J. Kozma
*Attorney, Agent, or Firm*—Lindenberg, Freilich, Wasserman, Rosen & Fernandez

[57] ABSTRACT

A miniature inductor comprising a sheet metal frame having a slot that divides the frame into two separated halves, each half having a pair of upstanding tabs and a pair of inclined tapered flanges. A plate of insulating material extends across the slot and is held in position by the tabs, while a bobbin lies on the insulator and has its ends attached to the flanges. A mass of plastic encapsulates all of the components except for the bottom surfaces of the frame halves which serve as terminals.

5 Claims, 6 Drawing Figures

Fig. 1
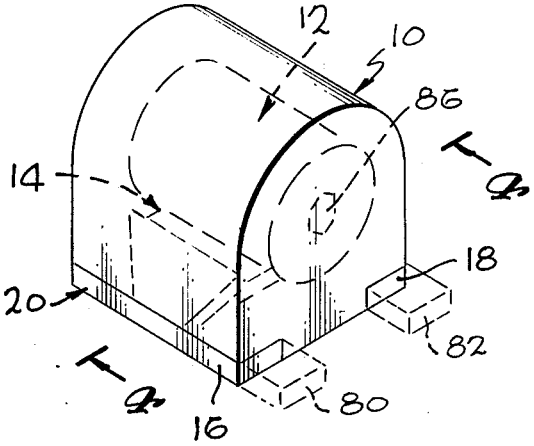
Fig. 3
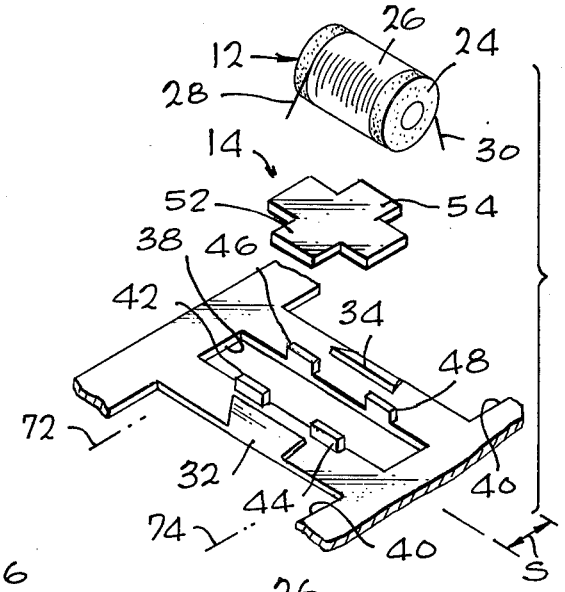
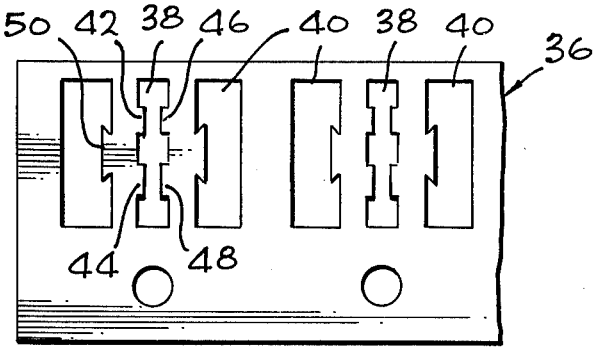
Fig. 2
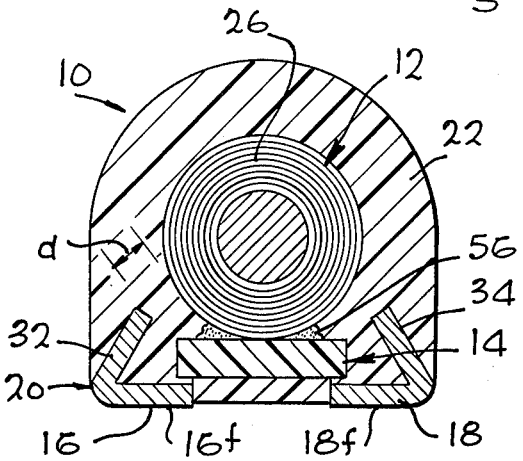
Fig. 4
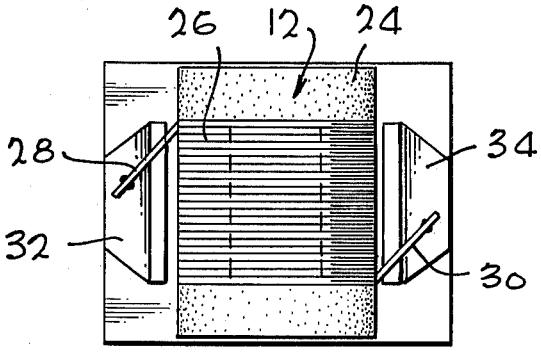
Fig. 5
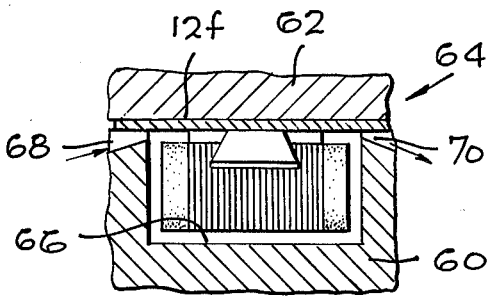
Fig. 6

COMPACT INDUCTOR

BACKGROUND OF THE INVENTION

This invention relates to inductors and methods for making them.

A miniature inductor can be formed by utilizing a bobbin which is held by a pair of arms of a frame of substantially nonmagnetic material. However, the presence of such metal adjacent to the bobbin can result in interference with the magnetic lines of force produced by the bobbin and therefore degrade the performance, or Q (ratio of reactance to resistance) of the inductor when used at very high frequencies. A miniature inductor which can be produced at low cost without significantly degrading the magnetic characteristics of the bobbin, would enable high performance compact circuitry to be provided at low cost.

SUMMARY OF THE INVENTION

In accordance with one embodiment of the present invention, a miniature inductor and method for manufacturing it are provided, which result in a high performance and low cost inductor. The inductor includes a flat frame with a slot down the middle which divides it into two separated halves. Each frame half has a pair of upstanding tabs bordering the slot, and a partially upstanding flange. A cruciform-shaped plate of insulative material bridges the slot and is positioned by the tabs, and a bobbin is cemented to the insulator and has the ends of its wires welded to the two flanges. The entire assembly is encapsulated in plastic, except for the bottom surfaces of the frame halves. The flanges extend at an incline from a direction perpendicular to the rest of the frame, and each flange is tapered so its upper end is of greatest width, to securely hold the encapsulating material to the frame halves.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a miniature inductor constructed in accordance with one embodiment of the present invention;

FIG. 2 is a plan view of a portion of a frame utilized in the construction of inductors of the type shown in FIG. 1;

FIG. 3 illustrates an assembly of parts utilized with the frame of FIG. 2 in the construction of the inductor of FIG. 1;

FIG. 4 is a sectional view taken on the line 4—4 of FIG. 1;

FIG. 5 is a plan view of the inductor of FIG. 4, but shown without encapsulating material; and FIG. 6 is a sectional side view showing a step in the process of manufacture of the inductor of FIG. 1.

DESCRIPTION OF THE PREFERRED EMBODIMENTS

As illustrated in FIGS. 1, 4 and 5, the inductor 10 includes a bobbin 12 mounted on an insulator 14, and with the insulator mounted on two halves 16, 18 of a frame 20. This assembly is encapsulated in a mass 22 of nonmagnetic and electrically insulative material such as a molding plastic, but with the lower faces 16f, 18f of the frame halves being exposed. The bobbin 12 includes a spool 24 of sintered powdered iron or other magnetic material of low remanence, and a coil 26 of electrically conductive wire such as copper which has an insulative coating and which is wound about the spool. The ends 28, 30 of the wire of the coil are welded to inclined flanges 32, 34 of the frame halves.

The inductor is constructed by first forming a lead frame of the type shown at 36 in FIG. 2. The lead frame has a row of mount holes 38, and has spacer holes 40 disposed between the mount holes. The perimeter of each mount hole 38 is formed with two pairs of tabs, one pair of tabs 42, 44 lying on one side of the mount hole and the other pair 46, 48 lying on the opposite side of the holes. The perimeter of each spacer hole 40 includes a flange 50 along one edge thereof which is nearest an adjacent mount hole. The lead frame is readied for use by bending up the tabs 42 – 48 and the flanges 50 as shown in FIG. 3. The insulator 14, which is of cruciform shape, is then installed to extend across the mount hole 38, and with two legs 52, 54 of the insulator closely received between the two pairs of upstanding tabs 42 – 48 to hold the insulator in position. The bobbin 12 is then installed on the insulator 14 and is held thereon by adhesive such as a drop 56 of epoxy glue. The wire ends 28, 30 are then welded to the flanges 32, 34 of the frame.

After a row of insulators and bobbins have been installed on the lead frame over the different mount holes 38 thereon, the lead frame is placed, as shown in FIG. 6, between two halves 60, 62 of a transfer mold 64. The transfer mold has a row of cavities 66, which each receive a bobbin, insulator, and portion of the lead frame. With the bottom face 12f of the frame (which is now facing upwardly) pressing against the upper half 62 of the transfer mold, the plastic molding, or encapsulating, material is forced into the cavity through a gate 68, while air is allowed to escape from the cavity through a passage 70 at the other end of the mold. The encapsulating material thus encapsulates all portions of the inductor assembly, but leaves the bottom face 12f of the frame exposed. The lead frame with the encapsulated assemblies thereon is then removed and placed in a trimming tool which trims the frame along the trim lines 72, 74 indicated in FIG. 3, which lies substantially even with the end of the encapsulating mass.

The trimming operation releases the plurality of inductors from the rest of the lead frame, and results in the two frame halves 16, 18 on opposite sides of the mount hole or slot 38 being physically separated from each other. The bottom surfaces of these frame halves are also exposed and serve as terminals for connection of electrical devices to the wire coil of the bobbin.

The flanges 32, 34 of the frame serve not only as weld locations for the ends of the wire coil, but also serve to securely hold the mass 22 of encapsulating material to the frame halves. To this end, the flanges are bent to extend at an upward incline which is angled by at least several degrees from a direction perpendicular, or normal, to a substantially flat frame region 75, the flanges shown in FIG. 4 being oriented approximately 30° from a normal direction. In addition, each flange such as 32 is tapered, with the upper end 32u of the flange being considerably wider that the lower end of the flange which meets the rest of the frame. This provides an "undercut", to prevent separation of the encapsulating mass in any direction from the frame halves, even when the inductor is hot and the encapsulating material is softened. It may be noted that the ends of the flanges are spaced an appreciable distance d from the wire coil 26.

This spacing serves to keep the metal of the frame away from the coil to minimize interference with the magnetic lines of force established by the coil. The insulator 14 serves to raise the bobbin so that most of the mass of the metal frame halves are spaced a considerable distances from the coil.

The frame halves 16, 18 are formed of phosphor bronze which is tin plated, to engage welding of the coil ends to the flanges thereof and the soldering of the exposed bottom face of the completed inductor into a circuit. Although the phosphor bronze is normally not considered a magnetic material, it does have some magnetic properties. When flanges of this type of material were placed against the coil and high frequency currents were passed through the coil, it was found that the Q (ratio of reactance to resistance of an inductor) of the coil decreased about 25%. The spacing d of the flange ends by at least half the thickness of the frame, provides sufficient separation to substantially eliminate reduction of Q.

In order to facilitate assembly of the insulator 14, as indicated in FIG. 3, the insulator is formed in a cruciform shape, with four legs that are all of equal width. In addition, the width of the mount hole 38 which equals the space s between the tabs, is made approximately equal to the width of the legs of the insulator. This permits the person assembling the inductors to install the insulators at any of four rotational positions.

The inductor illustrated in FIG. 1 can be modified in several ways for different applications. Where projecting leads are desired, it is possible to trim one side of the lead frame so that a pair of projecting leads indicated at 80, 82 in FIG. 1 are provided. Where a variable inductor is required, a bobbin can be utilized which has a threaded hole along the axis of the spool and a threaded slug which can screw into and out of the hole. In that case, the lead frame can be installed in the transfer mold so that one end face of the bobbin is not encapsulated, to leave a wrench-receiving recess, indicated at 86, uncovered for adjusting the inductance.

Thus, the invention provides a miniature inductor and method for constructing the same, which enables the construction of a rugged and efficient inductor at low cost. This is accomplished by providing a frame with two separated halves that have upstanding tabs for holding an insulator that bridges the slot between the halves, and with the frame having partially upstanding and tapered flanges for facilitating connection to the ends of the coil and for securely holding encapsulating material to the frame halves.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. An inductor comprising:

a flat frame of sheet metal having a mount slot extending thereacross to divide the frame into two separated frame halves;

each frame half having upper and lower surfaces and a pair of upstanding tabs lying at the edge of said slot, the two tabs of each pair being spaced a predetermined distance apart, and each frame half having a partially upstanding flange which is spaced from the slot and which is tapered in width with the top being of greatest width and which extends at less than 90° from the plane of the frame;

a plate of insulating material extending across said slot and having a pair of legs, each leg received between a pair of tabs;

a bobbin which includes a coil of electrically conductive wire wound on a spool, said bobbin being mounted on said insulator, and the ends of said wire being attached to different ones of said flanges, the top of each flange being spaced from said coil to leave a space between them; and a mass of electrically insulative encapsulating material disposed about said bobbin, said flanges, said tabs, and said insulator, but the bottom surfaces of each frame half being exposed for the making of electrical connection thereto.

2. An inductor comprising:

a frame of sheet metal having a mount slot dividing the frame into two separated portions, and having a pair of upstanding spaced tabs on opposite sides of the slot;

an insulator disposed on said frame and extending across said mount slot, said insulator comprising a plate having a leg on each side thereof, with each of said legs received between a pair of said tabs;

a coil assembly disposed on said insulator and lying over said mount slot, said coil having two leads attached to portions of said frame which lie on opposite sides of said mount slot; and nonmagnetic and electrically insulative molding material encapsulating said coil assembly and at least part of said frame to hold them together.

3. The inductor described in claim 2 wherein:

said insulator has four legs, all of substantially the same width; and the space across said slot, between the two pairs of tabs is substantially equal to the distance between the two tabs of each pair of tabs, whereby the insulator can be installed in any of four orientations.

4. Apparatus for use in constructing inductors, comprising:

a strip-shaped lead frame formed of a strip of metal, said frame having a plurality of mount holes spaced therealong and having at least one spacer hole lying between each pair of mount holes, said frame having a plurality of bent-up tabs extending from opposite sides of said mount holes, and said frame having a bent-up flange extending into each of said spacer holes;

a plurality of insulators, each received over a mount hole and against a bent-up tab;

a plurality of coil assemblies, each disposed on one of said insulators; and a plurality of masses of substantially nonmagnetic and electrically insulative encapsulating material, each disposed about a coil assembly, insulator, a pair of tabs, and a flange.

5. The apparatus described in claim 4 wherein:

each flange extends at an angle of less than 90° from the plane of said strip-shaped frame, and is tapered in width with its top wider than its bottom, whereby to securely hold the encapsulating material to the frame.

* * * * *